US005535734A

United States Patent [19]

Lu et al.

[11] Patent Number: 5,535,734

[45] Date of Patent: Jul. 16, 1996

[54] UNDERWATER BREATHING APPARATUS

[76] Inventors: Mike C. T. Lu; Amy H. Lu, both of 5234 Drexel Ave., Pennsauken, N.J. 08109

[21] Appl. No.: 378,837

[22] Filed: Jan. 26, 1995

[51] Int. Cl.[6] ..... A62B 7/02

[52] U.S. Cl. ..... 128/201.27; 128/201.11

[58] Field of Search ..... 128/201.27, 201.11, 128/202.14, 200.29, 201.26, 204.18, 205.18, 204.26

[56] References Cited

U.S. PATENT DOCUMENTS

| | | | |
|---|---|---|---|
| 120,089 | 10/1871 | Ormsbee | 128/201.11 |
| 813,431 | 2/1906 | Zwanami et al. | 128/201.27 |
| 4,986,267 | 1/1991 | Doss | 128/201.27 |
| 5,117,817 | 6/1992 | Lin | 128/201.11 |
| 5,193,530 | 3/1993 | Gamow et al. | 128/201.27 |

FOREIGN PATENT DOCUMENTS

| | | | |
|---|---|---|---|
| 164933 | 12/1949 | Austria | 128/201.11 |
| 1139978 | 2/1957 | France | 128/201.11 |
| 594198 | 5/1959 | Italy | 128/201.11 |

*Primary Examiner*—Edgar S. Burr
*Assistant Examiner*—William J. Deane, Jr.
*Attorney, Agent, or Firm*—John Lezdey; Allan Kutzenco

[57] ABSTRACT

The present invention provides an underwater breathing device that does not require the use of a pump, engine or pressurized air supply. The invention includes two overlapping hollow cylindrical tubes. The outer tube has holes at its base to let the flow of air move inside the device, up the inside of the outer tube and into the inner tube so that the swimmer can breath in air without any water. The device is constructed to operate whether it is right side up or upside down and can be utilized by more than one swimmer at the same time.

8 Claims, 4 Drawing Sheets

UNDERWATER BREATHING APPARATUS

BACKGROUND OF THE INVENTION

1. Field of the Invention

The present invention relates to an apparatus and method thereof for breathing under the water without the aid of any pumps, engines or pressurized air supplies.

2. Description of the Prior Art

Many different underwater breathing devices are known which utilize mechanical or electrical means to move the air. Some devices employ engines and/or pressurized air supplies to facilitate the movement of the air. Examples of such types of devices are disclosed in U.S. Pat. No. 4,986,267 to Doss, U.S. Pat. No. 4,674,493 to Mitchell, U.S. Pat. No. 4,269,182 to Le, U.S. Pat. No. 4,061,140 to Saito, U.S. Pat. No. 3,467,091 to Aragona, U.S. Pat. No. 3,370,586 to Aragona et al, U.S. Pat. No. 3,064,646 to Miller, U.S. Pat. No. 2,814,292 to Girden, U.S. Pat. No. 2,362,240 to Bonilla, U.S. Pat. No. 1,978,104 to Evenden et al, U.S. Pat. No. 1,423,923 to Eckerd and U.S. Pat. No. 1,369,669 to Kamenos, all incorporated herein by reference.

The simplest known underwater breathing device is a snorkel, which is simply a tube extending from the swimmer's mouth to the surface. The disadvantage of a snorkel is that a swimmer would have to hold his breath to go any deeper than the surface of the water. Another known device is a pressurized tank, which a swimmer wears on his or her back to supply air through a hose and regulator configuration. This type of device enables the swimmer to breathe at depths below the surface of the water because the tank provides air at sufficient pressure to compensate for the water pressure at the particular depth. Such a device, however, requires the swimmer to undergo an extensive training course in the United States because of the dangers involved in breathing highly pressurized air and requires the swimmer to carry around a lot of weight in equipment.

Another known method for breathing under water is to have a pump located on the surface of the water, for example, on a boat, or otherwise pumping air through a pressure hose to the underwater swimmer. The air may be fed to the swimmer through a regulator or may simply be fed into a pressurized suit worn by the swimmer, such as those used for deep sea diving. Another known device has been designed to float independently on the surface of the water and pump air at relatively shallow depths to an underwater swimmer. Such a device usually consists of a pump and a gasoline engine which are held afloat by attaching them to an innertube. Such a device, however, is only marginally seaworthy and risks contamination of the air from the exhaust of the gasoline engine.

Another known device utilizes an electric motor, a pump and pressurized air to overcome the contamination problem. And yet another known device employs a dual float, ball and rod valve for keeping water out of the air passageway without the use of an oxygen system.

None of these prior art devices, however, disclose the specific structure and advantages taught by the present invention. More particularly, the present invention provides an underwater breathing apparatus for shallow water diving situations without the aid of engines, pressurized cabins, dual float and ball devices and other mechanical or electrical driven type devices.

Thus, there exists a need for a simple and small floating device which can transfer air from the surface above the water to a swimmer underneath the water. The primary object of this invention is to provide such a type of device and which overcomes the prior art limitations and disadvantages.

A further object of this invention is to provide an underwater breathing apparatus and method thereof without the aid of engines, electronics, pressurized supply systems, dual float assemblies or the like.

A still further object of this invention is to provide a floating underwater breathing apparatus which will operate in both calm and turbulent waters.

Yet another object of this invention is to provide an apparatus of the type described above which is compact, durable, safe, economical and easy to use.

SUMMARY OF THE INVENTION

The present invention relates to an underwater breathing apparatus that floats on the surface of the water and is connected to the underwater swimmer by way of at least one air tube. The apparatus comprises a buoyant device having an opening or hole through the center portion which keeps the apparatus on the surface of the water. Two rigid overlapping cylindrical hollow tubular portions are secured together on the buoyant device at the opening. The outer tubular portion is closed at the top and has a series of holes near the base. The holes go only as high as the height of the buoyant device. The inner tubular portion is open at the top and goes substantially up the length of the outer tubular portion. A flexible hollow tubular portion is connected to the inner tubular portion near the base.

The combination provided by the present invention facilitates the flow of air above the surface of the water through the holes of the outer tubular portion, up the inside of the outer tubular portion, down through the opening of the inner tubular portion, through a flexible hollow tubular portion and finally to the mouth of the underwater swimmer. The breathing apparatus is so designed that it will operate right side up as well as upside down. Therefore, the present invention is useful in calm waters, e.g., a pool, as well as in turbulent waters, e.g., an ocean.

In other embodiments of the present invention, various optional elements are added such as: a valve means for adapting the breathing apparatus for multi-swimmer operability, a hand pump for reducing pressure blocks in the air passageway, an air driven fan assembly for facilitating the movement of air through the passageway, an additional buoyant ring stabilizer for improved buoyancy, gaskets, goggles, mouthpieces, securing straps and the like.

The advantages and objects of the present invention will become evident by referring to the following description and claims taken in conjunction with the accompanying drawings.

DESCRIPTION OF THE PREFERRED EMBODIMENTS

Figure 1:
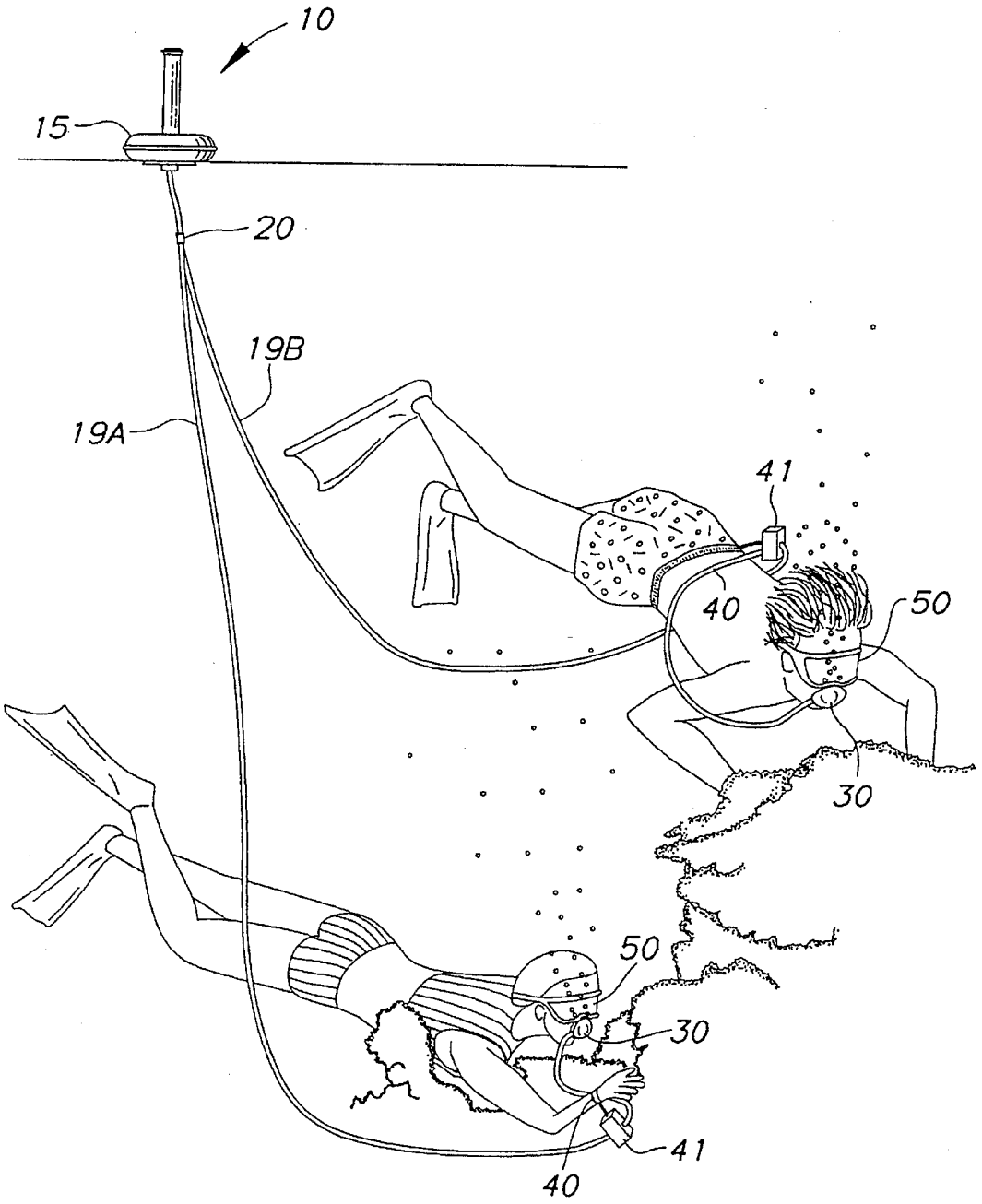
FIG. 1 is a pictorial view of the present invention being used by two underwater swimmers.

Referring now to the drawings, the underwater breathing apparatus 10 of the present invention is illustrated in various stages and embodiments in FIGS. 1–6, inclusive. As shown in FIG. 1, the breathing apparatus 10 floats on the surface of the water by way of a buoyant device 15 and has one or more hoses 19A,19B which act as conduits of air from the surface to the swimmer under the water.

Figure 2:
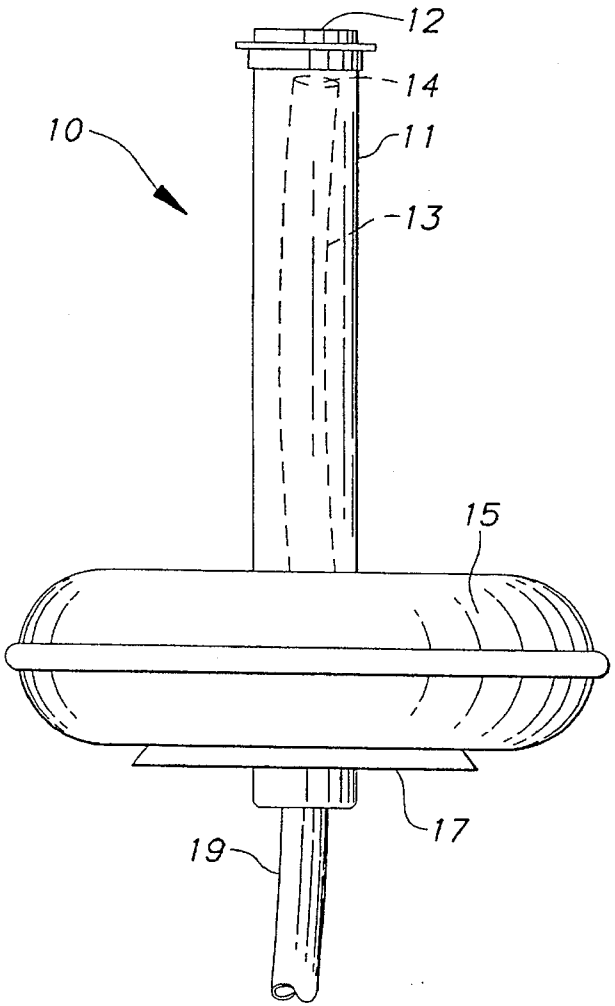
FIG. 2 is an exploded view of the base and top part of the breathing apparatus shown in FIG. 1.

Referring to FIG. 2, it can be seen that for the purpose of floatation, the breathing apparatus 10 utilizes a buoyant device 15 having an opening. Two rigid overlapping cylindrical hollow tubular portions 11,13 are secured together and attached to the buoyant device at the opening. It would be advantageous and efficient to secure both tubular portions 11,13 and the buoyant device 15 to a gasket 17 that is affixed to the bottom side of the buoyant device 15. The gasket 17 can improve sealing of the elements as well as provide stabilization of the device. The inner tubular portion 13 is shorter than the outer tubular portion 11. Preferably, the inner tubular portion 13 is 75–90% the height of the outer tubular portion 11.

The top 14 of the inner tubular portion 13 is open for transferring the air from the surface to under the water. A flexible hollow tubular portion 19 is connected to the inner portion 13 near the base of the breathing apparatus. The outer tubular portion 11 is closed at the top, usually by a lid, tab 12 or other similar sealing type article.

Figure 3:
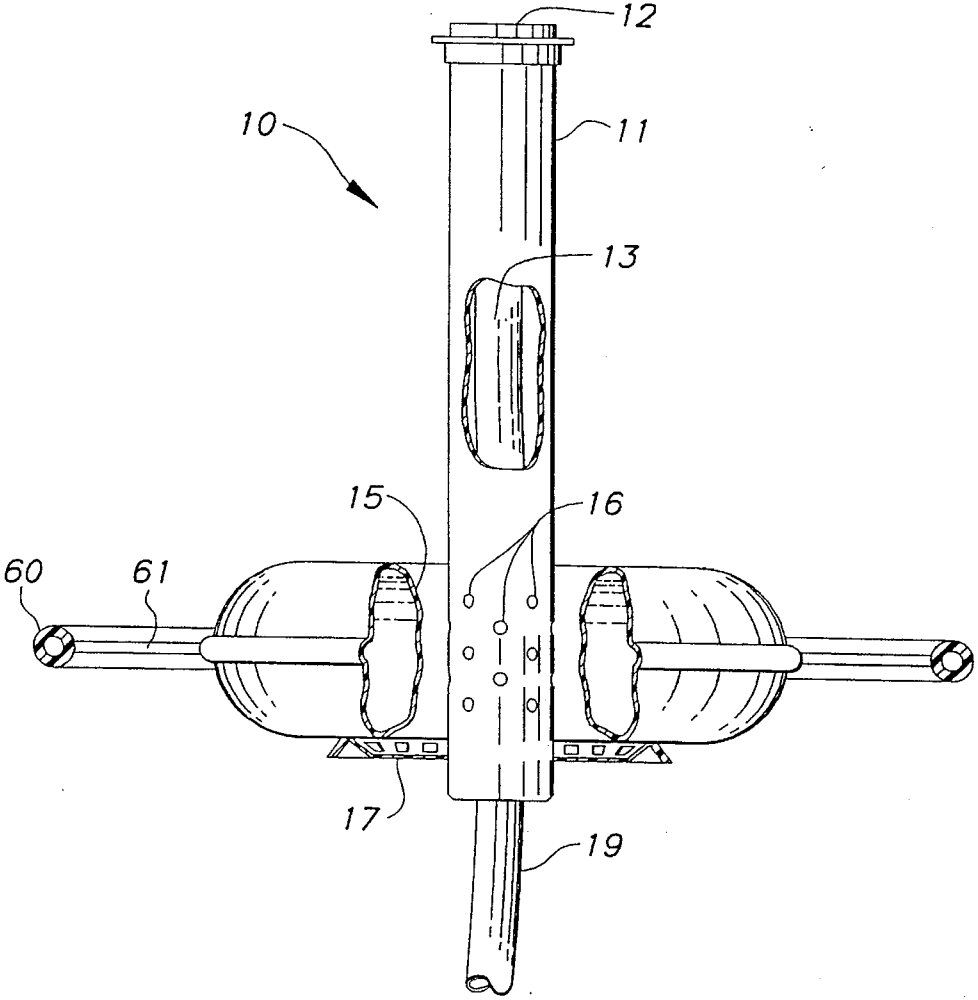
FIG. 3 is a cross-sectional view of the inner and outer tubes and the buoyant device shown in FIG. 2 and further illustrates an optional ring stabilizer.

FIG. 3, in conjunction with FIGS. 1 and 2, illustrates how the present invention works. The lower part of the outer tubular portion 11 has a series of holes 16 punched around its circumference. The holes 16 begin right above the bottom part of the buoyant device 15 and end right below the top part of the buoyant device 15.

It now can be seen how the apparatus operates. When the underwater swimmer breathes in, air will permeate through the holes 16 of the outer tubular portion 11, move up the inside of the outer tubular portion 11, move through the top 14 of the inner tubular portion 13, move down the inner tubular portion 13, move into the flexible tubular portion 19 and move finally into the underwater swimmer's mouth. The lid or tab 12 closing the outer tubular portion 11 helps prevent the introduction of any water into the inner tubular portion 13. As mentioned before, the gasket 17 can be optionally added for stabilization and sealing use.

Another embodiment of the present invention is illustrated in FIG. 3. In addition to all of the elements previously mentioned, it may be desirable to add a second buoyant device 60 for improved stabilization of the breathing apparatus 10. The second buoyant device 60 will close the first buoyant device 15 and a series of arms 61, preferably equidistantally apart, will bridge the two buoyant devices 15,60 together. The arms 16 will all be of substantially the same size so as to form, after attachment of the two buoyant devices 15,60, a single concentrical buoyant device. The second buoyant device 60 and its arms 61, need not be as wide or thick as the dimensions shown for the first buoyant device 15 because the holes 16 and other elements are supported through the first buoyant device 15.

Figure 5:
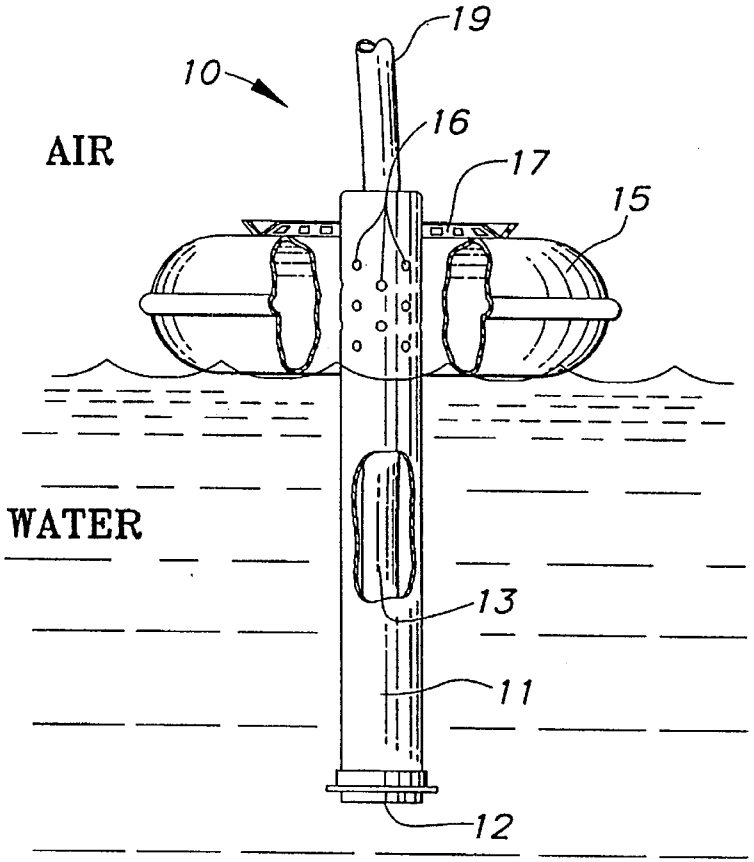
FIG. 5 is the same view as shown in FIG. 4 except that the breathing apparatus is upside down.
Figure 4:
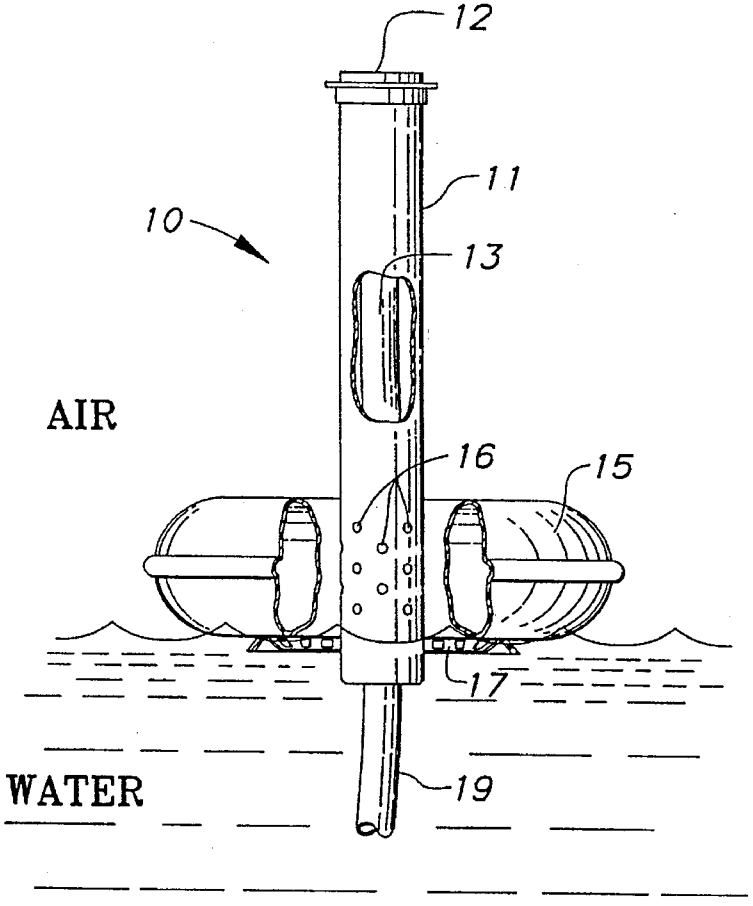
FIG. 4 is a cross-sectional view of the present invention as shown in FIG. 3 further showing the spatial relationship of each element to the air and the water.
Figure 6:
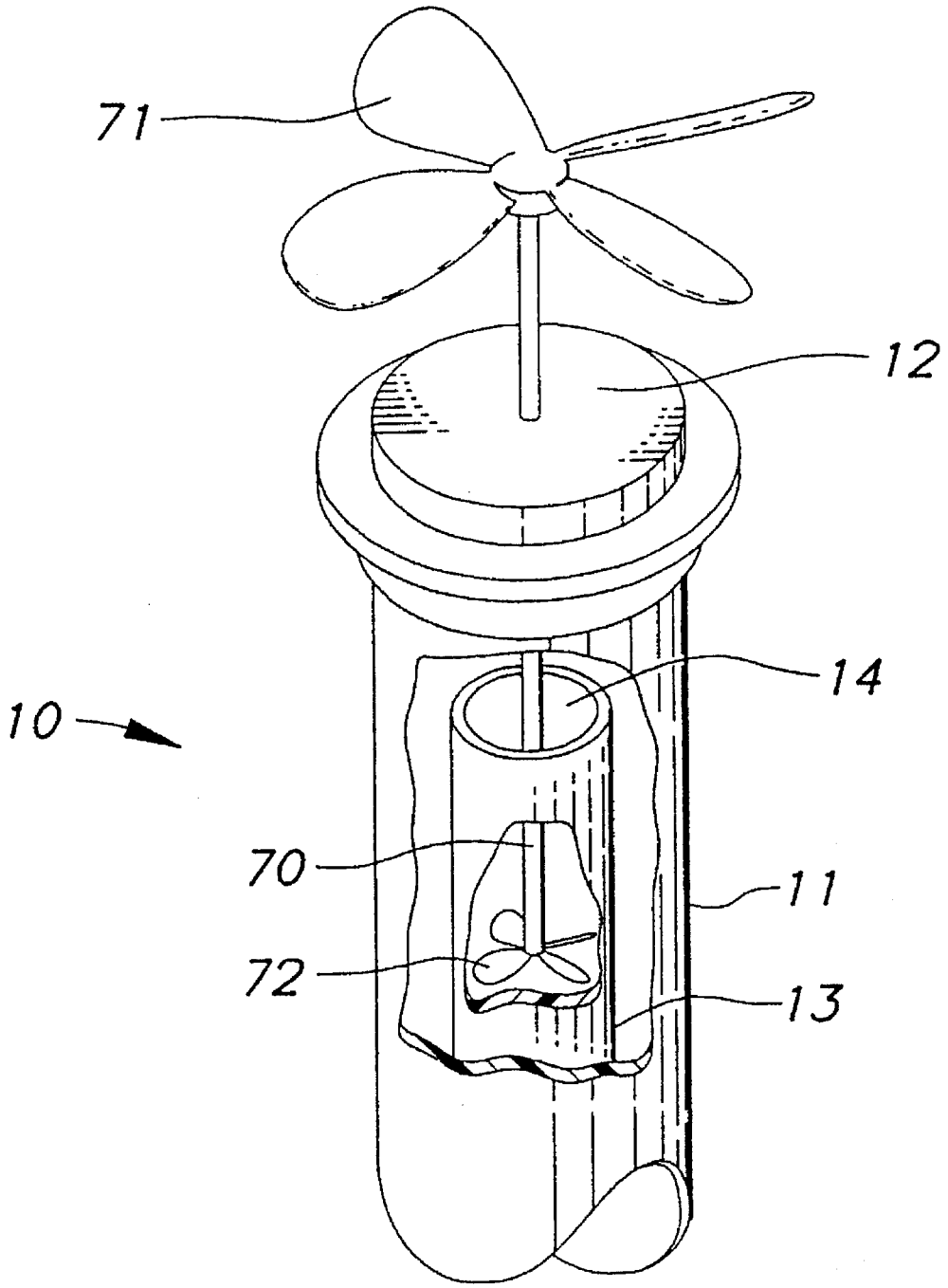
FIG. 6 is an exploded view of the top part of the breathing apparatus shown in FIG. 1 further illustrating an optional fan blade assembly.

FIGS. 4 and 5 illustrate a prime feature of the present invention. As mentioned earlier, the holes 16 of the outer tubular portion 11 are confined to the boundary defined by the height of the first buoyant device 15. Consequently, it can be seen that when the device is capsized by a wave or otherwise turned upside down, the holes 16 permitting the passage of air are always above the surface of the water. This feature helps keep water out of the inside of the breathing apparatus 10. Thus, the apparatus 10 can operate whether it is right side up or upside down.

While the breathing apparatus 10 is designed to work no matter which side is facing up, it is understood that the preferred usage is for the rigid overlapping tubular portions 11,13 to be pointing out of the water. This direction ensures the operability of another feature of the present invention to help prevent the air passageway from being mixed with water; when water does manage to enter through the holes 16, for example, by the breaking of waves or splashing, the water being heavier than air cannot overcome gravity and climb the walls of the tubular portions 11,13. Thus, the air passageway is kept essentially clear of any water because the air holes are always above the surface of the water and further because the tubular portions 11,13 are above the surface of the water when the breathing apparatus 10 is right side up.

Another embodiment of the present invention is illustrated in FIG. 6o Advantageously, an air driven fan device 70,71,72 is fixedly attached to the inner hollow tubular portion 13. It is anticipated that the fan device may employ one or two fan blade assemblies 71,72 connected and held together by a shaft 70. At least one fan blade assembly 71 protrudes through the top 12 of the breathing apparatus 10 so that it may catch the wind and help propel air continuously throughout the apparatus 10. While one type of fan blade assembly is illustrated, it is understood that other conventional types may be employed instead.

The materials useful for making the breathing apparatus are varied and plentiful, limited only by the characteristics specified for each element. For example, the buoyant devices may comprise styrofoam, hollow rigid plastic tubing such as polyolefin, inflatable tubing, or the like. The shape is not critical but a donut shape buoyant device is preferred.

Referring back to FIG. 1, other embodiments of the present invention are further illustrated. If desired, a valve means 20 may be coupled to the flexible hollow tubular portion 19. This feature would allow for simultaneous use of the breathing apparatus by two or more swimmers. Depending upon the number of swimmers, an appropriate type valve means 20 is attached. As shown in FIG. 1, a two-way valve means 20 is used to split the flexible hollow tubular portion 19 into two separate portions 19A,19B. Each tubular portion 19A,19B goes to a different swimmer.

The flexible tubular portions 19A, 19B are preferably attached to the body of the swimmer with an adjustable strap 40. This is advantageous for taking the pressure off of the swimmer's face when he or she is swimming and pulling the breathing apparatus 10 along the surface of the water. The adjustable strap 40 is usually secured around the swimmer's wrist or waist. Then, the wrist or waist will bear the brunt of the force of moving the breathing apparatus 10.

Preferably, a hand pump 41 is also employed in the present invention for when the swimmer goes to greater depths beneath the water. A hand pump 41 can be squeezed at the discretion of the swimmer to remove any air pressure blocks and to provide for a constant flow of air. This is especially useful for swimmers who want to go more than five feet under the water because the further one goes under the surface of the water, the more the water pressure differences will affect the flow of the air. If an air pressure block develops, it may be eliminated by squeezing the hand pump. And, a swimmer who is planning to go far under the surface of the water could squeeze the hand pump several times before he or she dives to reduce the likelihood of any air pressure blocks.

FIG. 1 also illustrates the advantageous use of a conventional mouthpiece 30 and a pair of goggles 50. Preferably, the end of the tubular portion 19A,19B are fixedly attached to a mouth engaging member 30 near the swimmer end of the breathing apparatus 10. The mouth engaging member 30 should be flexible and wide enough to accommodate the normal breathing cadences of the swimmer. Finally, it may be desirable to secure a pair of goggles 50, face shield or the like above the mouthpiece 30. Goggles 50 are commonly used by underwater swimmers to improve the vision of the underwater swimmer.

In yet another embodiment of the present invention a method for breathing underwater is provided by inhaling through any of the embodiments of the breathing apparatus 10 described above and exhaling into the water.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed:

1. An underwater breathing apparatus comprising:

a buoyant device having an opening;

a pair of rigid overlapping cylindrical hollow tubular portions secured together and attached to the buoyant device at the opening;

the outer tubular portion having a plurality of apertures near the base and closed at the top, the apertures being contained within the boundaries defined by the height of the buoyant device so that when the apparatus sits in water rightside up or upside down, the apertures remain above the surface of the water;

the inner tubular portion being situated substantially along the length of the outer tubular portion and having an opening at the top for facilitating the flow of air; and a flexible hollow tubular portion connected to the inner tubular portion near the base of the breathing apparatus for facilitating the flow of air to an underwater swimmer.

2. The apparatus as described in claim 1 further comprising a second buoyant device fixedly attached around the first buoyant device with arms arranged equidistantly apart so as to form a single concentrical buoyant device.

3. The apparatus as described in claim 1 further comprising an adjustable strap attached near the swimmer end of the flexible hollow tubular portion for securing the breathing apparatus to the body of the swimmer.

4. The apparatus as described in claim 1 further comprising a gasket sealed to the bottom of the buoyant device and a valve means coupled to the flexible hollow tubular portion.

5. The apparatus as described in claim 1 further comprising a hand pump fixedly attached to the swimmer end of the flexible hollow tubular portion for maintaining a constant flow of air throughout the breathing apparatus.

6. The apparatus as described in claim 1 further comprising a mouth engaging member fixedly attached to the swimmer end of the flexible hollow tubular portion and goggles secured above the mouth engaging member.

7. An underwater breathing apparatus comprising:

a buoyant device having an opening;

a pair of rigid overlapping cylindrical hollow tubular portions secured together and attached to the buoyant device at the opening;

the outer tubular portion having a plurality of apertures near the base and closed at the top, the apertures being contained within the boundaries defined by the height of the buoyant device;

the inner tubular portion being situated substantially along the length of the outer tubular portion and having an opening at the top for facilitating the flow of air;

a flexible hollow tubular portion connected to the inner tubular portion near the base of the breathing apparatus for facilitating the flow of air to an underwater swimmer; and an air driven fan device fixedly attached to the inner tubular portion near the top of the breathing apparatus and positioned so that at least one fan blade assembly protrudes out of the top of the breathing apparatus.

8. A method for breathing underwater by inhaling air through the breathing device described in claim 1 and exhaling air into the water.

* * * * *